US012326295B2

(12) United States Patent
Ferreira et al.

(10) Patent No.: US 12,326,295 B2
(45) Date of Patent: Jun. 10, 2025

(54) REFRIGERATOR APPLIANCE WITH ROTATING MULLION BAR

(71) Applicant: WHIRLPOOL CORPORATION, Benton Harbor, MI (US)

(72) Inventors: Luiz Afranio Alves Ferreira, Joinville (BR); Gustavo Spezzia, Joinville (BR); Marco Aurelio Dellabruna Maccarini, Joinville (BR); Gabriel H Ortola, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 179 days.

(21) Appl. No.: 18/340,578

(22) Filed: Jun. 23, 2023

(65) Prior Publication Data

US 2024/0027125 A1 Jan. 25, 2024

Related U.S. Application Data

(60) Provisional application No. 63/391,037, filed on Jul. 21, 2022.

(51) Int. Cl.
*F25D 23/02* (2006.01)

(52) U.S. Cl.
CPC ..... *F25D 23/028* (2013.01); *F25D 2323/021* (2013.01)

(58) Field of Classification Search
CPC ..... F25D 23/028; F25D 2323/021
See application file for complete search history.

(56) References Cited

U.S. PATENT DOCUMENTS

| | | | | |
|---|---|---|---|---|
| 7,008,032 | B2 * | 3/2006 | Chekal | F25D 23/02 49/316 |
| 8,167,389 | B2 * | 5/2012 | Han | F25D 23/02 312/405 |
| 9,134,062 | B2 * | 9/2015 | Jung | F25D 23/087 |
| 9,631,857 | B2 * | 4/2017 | Yoon | F25D 23/028 |
| 10,544,982 | B2 * | 1/2020 | Kim | F25D 23/028 |
| 10,808,982 | B2 * | 10/2020 | Hanson | F25D 23/028 |
| 2009/0007608 | A1 | 1/2009 | Lorek | |
| 2012/0137722 | A1 * | 6/2012 | Kim | F25D 23/028 62/440 |

(Continued)

FOREIGN PATENT DOCUMENTS

| | | | | |
|---|---|---|---|---|
| CA | 3150448 A1 * | 2/2023 | | F25D 23/028 |
| CN | 102506547 A * | 6/2012 | | F25D 23/02 |
| CN | 103292540 A * | 9/2013 | | F25D 23/028 |

(Continued)

*Primary Examiner* — Hanh V Tran
(74) *Attorney, Agent, or Firm* — Brooks Kushman P.C.

(57) ABSTRACT

A refrigerator appliance includes a cabinet, a door pivotally attached to the cabinet, and a mullion bar pivotally attached to the door and having a guide pin. The mullion bar moves between a deployed position and a tucked position. A guide element is mounted to the cabinet and defines a recessed area. The guide element includes a deflectable member disposed in the recessed area and cooperating with a side wall of the recessed area to define an opening sized to receive the guide pin only when the mullion bar is in the tucked position. The deflectable member is deflectable upon contact with the guide pin to allow the guide pin within the recessed area when the mullion bar is in the deployed position.

20 Claims, 5 Drawing Sheets

(56) References Cited

U.S. PATENT DOCUMENTS

| | | | | | |
|---|---|---|---|---|---|
| 2024/0053086 | A1 * | 2/2024 | Jia | ..... | F25D 23/028 |

FOREIGN PATENT DOCUMENTS

| | | | | | | |
|---|---|---|---|---|---|---|
| CN | 104279823 | A | * | 1/2015 | ..... | F25D 23/028 |
| CN | 103307840 | B | * | 9/2015 | ..... | F25D 23/028 |
| DE | 102016202570 | A1 | * | 8/2017 | | |
| EP | 3034973 | B1 | * | 11/2017 | ..... | E05F 1/10 |
| KR | 20110032898 | A | * | 3/2011 | | |
| KR | 102548043 | B1 | * | 6/2023 | | |
| WO | WO-2009109878 | A1 | * | 9/2009 | ..... | E05D 11/105 |
| WO | WO-2012123035 | A1 | * | 9/2012 | ..... | F25D 23/028 |

* cited by examiner

REFRIGERATOR APPLIANCE WITH ROTATING MULLION BAR

CROSS-REFERENCE TO RELATED APPLICATIONS

This application claims the benefit of U.S. provisional application Ser. No. 63/391,037 filed Jul. 21, 2022, the disclosure of which is hereby incorporated in its entirety by reference herein.

TECHNICAL FIELD

The present disclosure relates to an appliance such as a refrigerator and more particularly to a rotating mullion bar assembly.

BACKGROUND

In order to keep food fresh, a low temperature must be maintained within a refrigerator to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

Refrigerators come in a variety of configurations. For example, refrigerators may have an upper fresh-food compartment and a bottom-mount freezer compartment. French-style doors may be arranged in side-by-side configurations to seal a fresh-food compartment.

SUMMARY

According to one embodiment, a refrigerator appliance includes a cabinet, first and second French-style doors each pivotally attached to the cabinet, and a mullion bar pivotally attached to the first door and having a guide pin. The mullion bar has a deployed position in which the mullion bar is positioned to support the second door and a tucked position. A guide element of the appliance is mounted to the cabinet and defines a guide path having an opening sized to receive the guide pin when the mullion bar is in the tucked position. The guide path is arranged such that the mullion bar pivots between the deployed and tucked positions as the guide pin moves along the guide path. The guide element includes a deflectable portion that forms a segment of the guide path and is deflectable upon contact with the guide pin to allow the guide pin within the guide path when the mullion bar is in the deployed position.

According to another embodiment, a refrigerator appliance includes a cabinet, a door pivotally attached to the cabinet, and a mullion bar pivotally attached to the door. The mullion bar has a guide pin and is movable between a deployed position and a tucked position. The refrigerator appliance further includes a guide element mounted to the cabinet and defining a recessed area. The guide element has a deflectable member disposed in the recessed area and cooperating with a side wall of the recessed area to define an opening sized to receive the guide pin only when the mullion bar is in the tucked position. The deflectable member is deflectable upon contact with the guide pin to allow the guide pin within the recessed area when the mullion bar is in the deployed position.

The deflectable member may be pivotal between a blocking position and a deflected position. The deflectable member is configured to move from the blocking position to the deflected position responsive to contact with the guide pin. The deflectable member may be biased to the blocking position. The deflectable member may have a front face with an angled or rounded surface.

The recessed area and the deflectable member may cooperate to define a guide path arranged such that the mullion bar pivots between the deployed and tucked positions as the guide pin moves along the guide path.

The guide element may attached to a top of the fresh-food compartment or a bottom of the fresh-food compartment. In some embodiments, the refrigerator appliance may include two guide elements, one on the top and the other on the bottom. The second guide element may be the same or similar to the first guide element.

The refrigerator appliance may further include a second door pivotally attached to the cabinet and configured to engage with the mullion bar when the second door is in the closed position.

According to yet another embodiment, a refrigerator appliance includes a cabinet and first and second doors arranged side-by-side and each pivotally attached to the cabinet. A mullion bar is pivotally attached to the first door and has a stationary guide pin. The mullion bar has a deployed position in which the mullion bar is positioned to support the second door and a tucked position. A guide element is supported by the cabinet. The guide element includes a base defining a recessed area and a latch disposed in the recessed area and cooperating with a side wall of the recessed area to define an opening sized to receive the guide pin only when the mullion bar is in the tucked position. The latch is configured to retract into the base upon contact with the guide pin during closing of the first door to allow the guide pin within the recessed area when the mullion bar is in the deployed position.

The base may be mounted to a top of the cabinet within the fresh-food compartment or may be mounted to a bottom of the fresh-food compartment. The base may define a slot through which the latch extends.

The latch may include a first position in which the latch extends through the slot and a second position in which the latch is retracted into the slot. The latch may be biased to the first position. For example, a spring, such as a coil spring, may be disposed in the base to bias the latch to the first position.

The latch may include a hooked end defining a front surface and a blocking surface. The blocking surface may cooperate with the recessed area to define a guide path arranged such that the mullion bar pivots between the deployed and tucked positions as the guide pin moves along the guide path. The blocking surface may be planar, and the front surface may have a rounded or angled portion.

The latch may be pivotally attached to the base by a pin and movable between a blocking position and a retracted position, and further comprise a spring coaxial with the pin and biasing the latch to the blocking position.

According to a further embodiment, a refrigerator appliance includes a cabinet, first and second doors arranged side-by-side and each pivotally attached to the cabinet, and a mullion bar pivotally attached to the first door and having a guide pin. The mullion bar has a deployed position in which the mullion bar is positioned to support the second door and a tucked position. A guide element is supported by the cabinet and defines a guide path having an opening sized to receive the guide pin when the mullion bar is in the tucked position. The guide path is arranged such that the mullion bar pivots between the deployed and tucked positions as the guide pin moves along the guide path. The guide element has a deflectable member that forms a segment of the guide path and is deflectable upon contact with the guide pin during closing of the first door to allow the guide pin within the guide path when the mullion bar is in the deployed position allowing the first door to close.

The deflectable member may be pivotally attached to a base member of the guide element. The deflectable member is pivotal between a blocking position in which the deflectable member projects out of the base member and a deflected position in which the deflectable member is retracted within the base member, wherein the deflectable member is configured to move from the blocking position to the deflected position responsive to contact with the guide pin.

The guide element may be mounted to a top of the cabinet, and the refrigerator appliance may further include a second guide pin attached to the mullion bar and a second guide element mounted to a bottom of the fresh-food compartment. The second guide element defines a second guide path having an opening sized to receive the second guide pin when the mullion bar is in the tucked position. The second guide path is arranged such that the mullion bar pivots between the deployed and tucked positions as the second guide pin moves along the second guide path, wherein the second guide element includes a second deflectable member that forms a segment of the second guide path and is deflectable upon contact with the second guide pin to allow the second guide pin within the second guide path when the mullion bar is in the deployed position.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Disclosed in detail below are refrigerators including first and second French-style doors, as well as a rotating mullion bar that enables independent operation of each of the first and second French-style doors. The rotating mullion bar interacts with a guide element for rotating the mullion bar.

Figure 2:
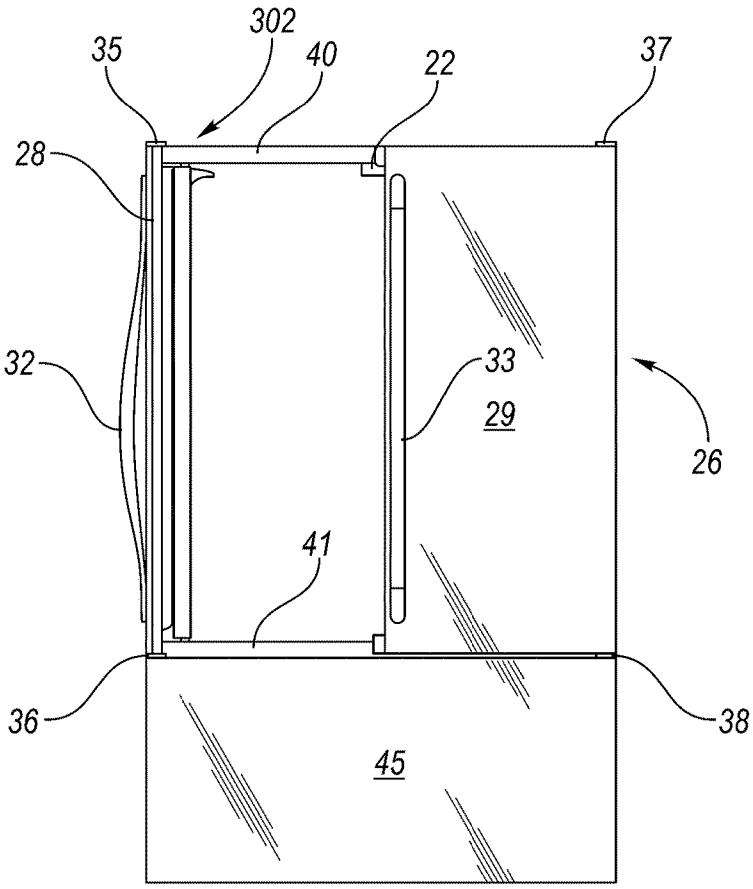
FIG. 2 is a front view of the refrigerator with one of the fresh-food compartment doors open and the other closed.
Figure 1:
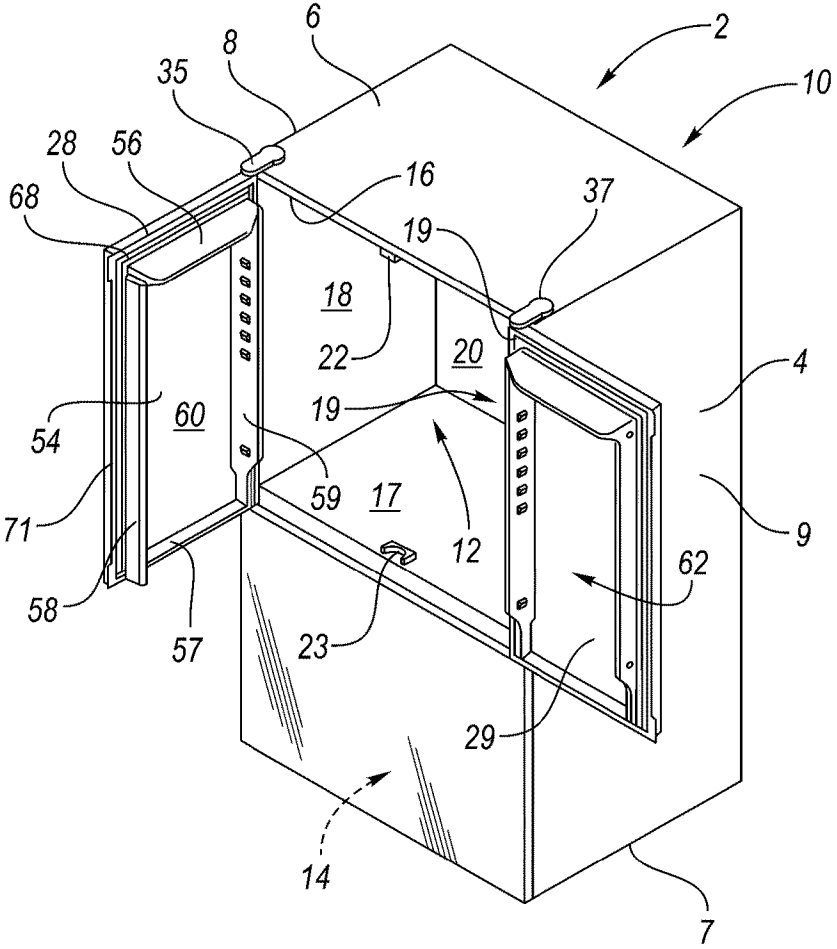
FIG. 1 is a front perspective view of a refrigerator appliance.

Referring to FIGS. 1 and 2, a refrigerator appliance 2 may include a cabinet shell 4 having a top wall 6, bottom wall 7, opposing side walls 8 and 9, and a rear wall 10 that combine to form first and second compartments 12 and 14. In the embodiment shown, first or fresh-food compartment 12 includes a liner having a top portion 16, a bottom portion 17, opposing side wall portions 18 and 19, and a rear wall portion 20. In addition, a guide element 22, which will be detailed more fully below, is arranged on the top portion 16. If desired, a second guide element 23 could be provided on the bottom portion 17 (optional). The guide element 23 may be the same or similar to guide element 22.

The refrigerator 2 is provided with an upper door assembly 26 that includes French-style doors having first and second doors members 28 and 29. The first and second doors 28 and 29 are provided with respective handles 32 and 33 to enable a user to operate the doors 28 and 29 providing access to the fresh-food compartment 12. The first and second doors 28 and 29 may pivot about upper and lower hinges 35 and 36, 37 and 38, respectively. As detailed more fully below, the first and second doors 28 and 29 are adapted to selectively seal against an upper front face portion 40 and a lower front face portion 41 to prevent cold air from escaping from the compartment 12. The first and second doors 28 and 29 may also seal against side portions of the cabinet 4. A lower or freezer door 45 enables access to the second or freezer compartment 14. In the embodiment shown, the refrigerator 2 is a bottom-mount configuration with a lower freezer door 45 being adapted to slide in and out of cabinet 4 to provide access to frozen goods located within the second compartment 14.

The structure of each door member 28 and 29 may be similar or identical. Therefore, the following description of door member 28 may apply equally to door member 29. As shown, a liner 54 is depicted as having an outwardly projecting top portion 56, bottom portion 57, opposing side portions 58 and 59 and a rear portion 60 that collectively define a storage cavity. The storage cavity 62 may be provided with a plurality of shelf support elements for supporting food items. The liner 54 is also provided with a sealing surface 68 having a flexible gasket 71 that seals the food compartment 12 when the doors are closed.

Figure 4:
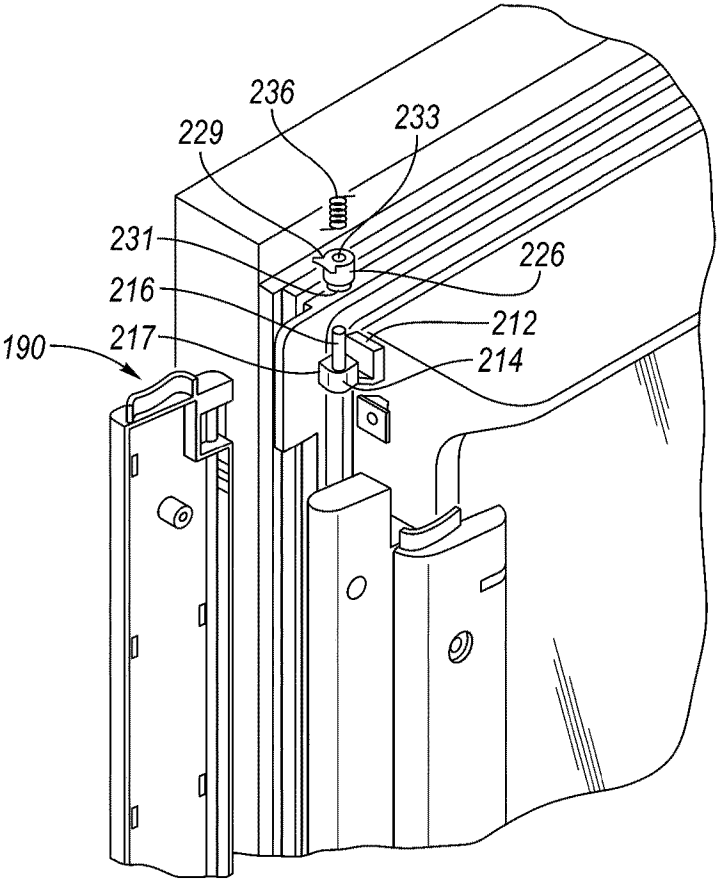
FIG. 4 is a partially exploded perspective view of the door, the rotating mullion, and the hinge elements.
Figure 3:
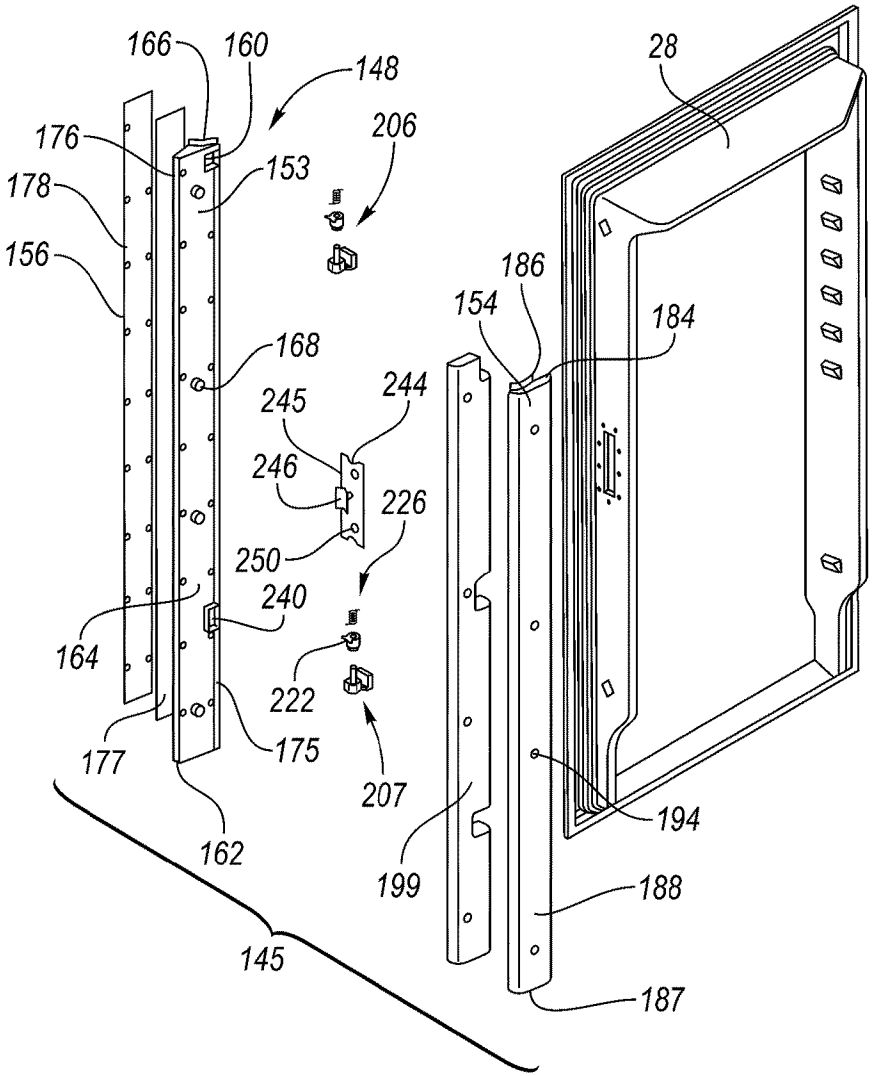
FIG. 3 is a partially exploded perspective view of a door and rotating mullion of the refrigerator appliance.

Referring to FIGS. 3 and 4, the refrigerator appliance 2 may have a mullion assembly 145 that includes the guide element 22 and a mullion bar 148 rotatably connected to the door 28 and configured to engage with the guide element 22 when the door 28 is closed. The mullion bar 148 may have first and second mullion bar members 153 and 154 and a trim piece 156. The trim piece 156 may be made of metal to enable a magnet of the gasket 71 to seal against the trim piece 156. The first mullion bar member 153 may include a first end 160, a second end 162, and an interconnecting transverse web portion 164. The first end 160 is provided with a guide pin portion 166. Additionally, the first mullion bar member 153 may include a plurality of mounting lugs 168 and a wire channel 175 that enables passage of an electrical conductor from door 28 to a heating element 177. The heating element is optional. The first mullion bar 153 also includes a plurality of trim-piece mounting slots, one of which is indicated at 176. The trim piece mounting slots 176 are sized to snap-fittingly receive a corresponding plurality of mounting projections 178 extending from trim piece 156.

The second mullion bar member 154 may have a first end 184 including a guide pin portion 186, a second end 187, and an interconnecting transverse web portion 188. The guide pin portions 166 and 186 collectively form the guide pin 190 that is configured to engage with the upper guide element 22 mounted within the fresh-food compartment 12. Although not required, a second guide pin portion may be provided on the bottom to engage with the optional lower guide element 23.

The second mullion bar member 154 may include a plurality of fastener receiving apertures 194, which, in the embodiment shown, are shaped to receive a hexagonal nut. With this arrangement, a plurality of mechanical fasteners (not shown) can be inserted through the plurality of mounting lugs 168 to engage with nuts (also not shown) received within fastener receiving members 194 to join first and second mullion bar members 153 and 154 to form the mullion bar 148. Of course, other connection arrangements, such as integral snap-connectors or glue, could also be employed. Finally, positioned between first and second mullion bar members 153 and 154 is an insulation strip 199. The insulating strip 199 may be formed from EPS insulation; however other forms of insulation, such as blown foam, may be used. The insulation strip 199 is positioned to slow cold air conduction through mullion bar 148 and reduce sweating.

The mullion bar assembly 145 may further include first and second hinge members 206 and 207 that pivotally secure the mullion bar 148 to the door member 28. Since the structure of each hinge member 206 and 207 may be common, a detailed description of hinge member 206 will be made and it is to be understood that hinge member 207 has commensurate structure in the illustrated embodiment. The hinge member 206 includes a first hinge element having a base portion 212 interconnected with a first, multi-lobed cam member 214. In the embodiment shown, a hinge pin 216 projects through the first cam member 214 and is spaced from the first cam member 214 by an interior cavity 217. The first hinge element 210 may be secured to first door member 28 by sliding a base portion 212 upon a dovetail clip secured to a side portion 58 of first door member 28.

The hinge member 206 may also include a second hinge element 222 that includes a second, multi-lobed cam member 226 and a mounting flange 229 adapted to interconnect with the first mullion bar portion 153. The second hinge element 222 further includes a cylindrical base portion 231 adapted to be received in an interior cavity 217 of the first hinge element 210. The second hinge element 222 includes a central bore 233 through which extends the hinge pin 216 that enables the first and second multi-lobed cam members 214 and 226 to nest one within the other. Finally, hinge member 206 incorporates a spring 236, such as a coil spring, positioned above second the hinge element 222 that is adapted to provide a biasing force holding the second hinge element 222 against the first hinge element 210. At this point, it is noted that the second hinge element 222 is mounted in the hinge mounting recess 240 established between the first and second bar portions 153 and 154, with the mounting flange 229 preventing relative rotation between the second hinge element 222 and the mullion bar 148 while the second hinge element 222 can vertically shift or translate relative to the first flange element 210 within hinge mounting recess 240.

The mullion assembly 145 may include a cover 244 having a base member 245 interconnected with a pivot member 246 through a conduit or sleeve. With this construction, either a control wire (not shown) can extend within first door member 28 and interconnect with the heating element 177 to heat mullion bar 148 so as to prevent condensation build-up on mullion bar 148 and first and second door members 28 and 29. In addition, base member 245 may be provided with a plurality of bumpers 250 that dampen the impact of the mullion bar 148 on a side portion 58 of the liner 54 when the door 28 is opened.

Figure 5A:
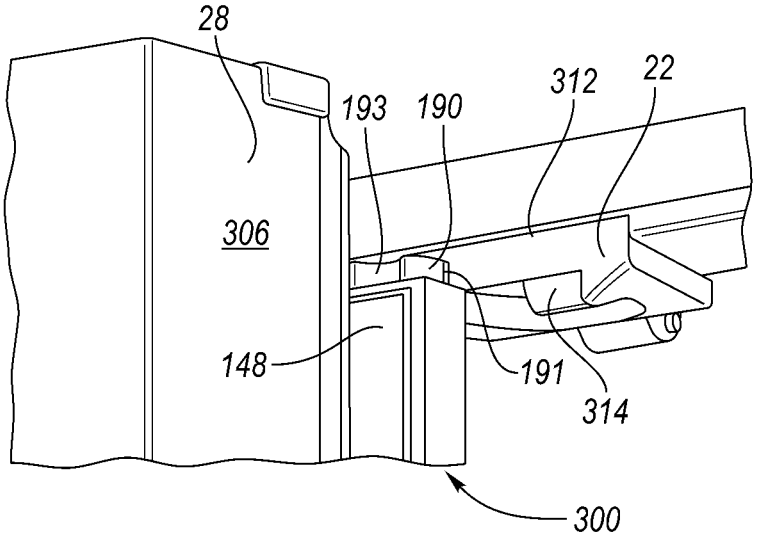
FIGS. 5A-5C show a door closing sequence.
Figure 6A:
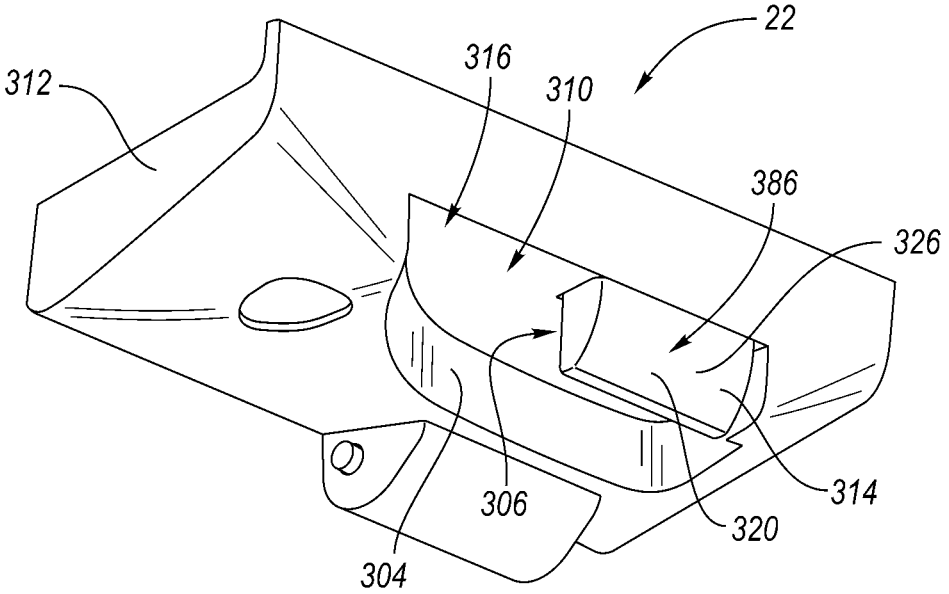
FIG. 6A shows a perspective view of a guide element with a latch shown in the blocking position.

Referring to FIGS. 5A and 6A, as discussed above, the mullion bar 148 is pivotally attached to the door 28 and is pivotable between a deployed position 300 in which the mullion bar 148 projects outwardly towards the other door 29 and a tucked position 302 in which the mullion bar 148 is rotated to be substantially parallel to the edge 306 of the door 28. (Mullion bar 148 is shown in deployed position; See FIG. 2 for illustration of tucked position.) In the refrigerator 2, the mullion bar 148 is designed to be in the deployed position 300 once the door 28 is fully closed to provide support and a sealing surface for the other door 29 and is designed to be in the tucked position 302 when the door is opened and when the door is closing but not yet fully seated.

The guide element 22 rotates the mullion bar 148 between the deployed position 300 and the tucked position 302. For example, the guide element 22 rotates the mullion bar 148 from the deployed position 300 to the tucked position 302 when the door 28 is opened and also rotates the mullion bar 148 back to the deployed position 300 when the door 28 is closed. This represents the normal or ideal operation of the mullion bar 148 during opening and closing of the door 28.

To do this, a base 312 of the guide element 22 defines a curved guide path 310 configured to engage with the guide pin 190 of the mullion bar 148 to pivot the mullion bar 148 relative to the door 28. The guide path 310 includes an opening 316, a first guide surface 304, and a blocking surface 306. The first guide surface 304, which is curved, engages with a front portion 191 of the guide pin 190 to rotate the mullion bar 148 towards the deployed position 300 as the guide pin 190 is further received into the guide path 310 during closing of the door 28. During opening of the door 28, the blocking surface 306 engages with a side portion 193 of the guide pin 190 to rotate the mullion bar 148 towards the tucked position 302.

The opening 316 of the guide path 310 is defined between the base 312 and a deflectable member, e.g., latch 314 of the illustrated example. The blocking surface 306 may be formed on the deflectable member 314. The opening 316 is wider than a width of the guide pin 190 but is narrower than a length of the guide pin 190. As such, the guide pin 190 is receivable through the opening 116 of the guide path 310 only when the mullion bar 148 is rotated to the tucked position 300. If the mullion bar 148 is rotated to the deployed position 300, the guide pin 190 cannot enter through the opening 316.

For example, it is possible for the mullion bar 148 to be rotated to the incorrect position, such as being in the deployed position 300 when the door 28 is open. When this happens, and the user closes the door, the guide pin 190 cannot enter through the opening 316 and instead the side portion 193 of the guide pin 190 contacts a front face 320 of the deflectable member 314. In some previous designs, the front face 320 was an immovable portion of the base (rather than a surface of a deflectable member) and thus the door 28 cannot be fully closed due to interference between the guide pin 190 and the guide element 22. This can result in customer annoyance, and if sufficient closing force is applied, damage to the guide pin or support element. To avoid this problem, the deflectable member 314 is deflectable allowing the guide pin 190 to enter the guide path 310 regardless of the orientation of the rotatable mullion bar 148.

Figure 5B:
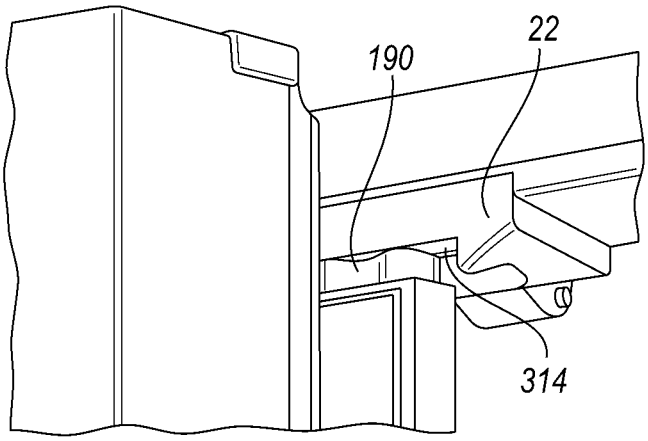
Figure 5C:
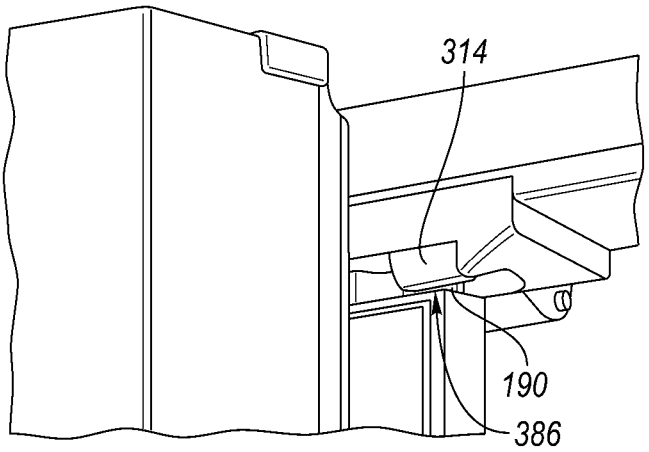

FIGS. 5A through 5C, illustrate a door closing sequence in which the rotatable mullion bar 148 is improperly rotated to the deployed position 300. In comparing FIGS. 5A to 5B, it can be seen that the deflectable member 314 deflects upwardly to accommodate the sideways guide pin 190 into the base 312 so that the door 28 can be fully closed. Once the guide pin 190 clears the deflectable member 314 and fully enters the guide path 312, the deflectable member 314 deflects downwardly to resting position 386. This repositions the blocking surface 306 into the correct orientation so that mullion bar 148 is properly rotated back to the tucked position 302 upon opening the door 28. That is, the guide element 22 automatically resets the mullion bar 148 for proper operation upon a future opening event of the door.

Figure 6B:
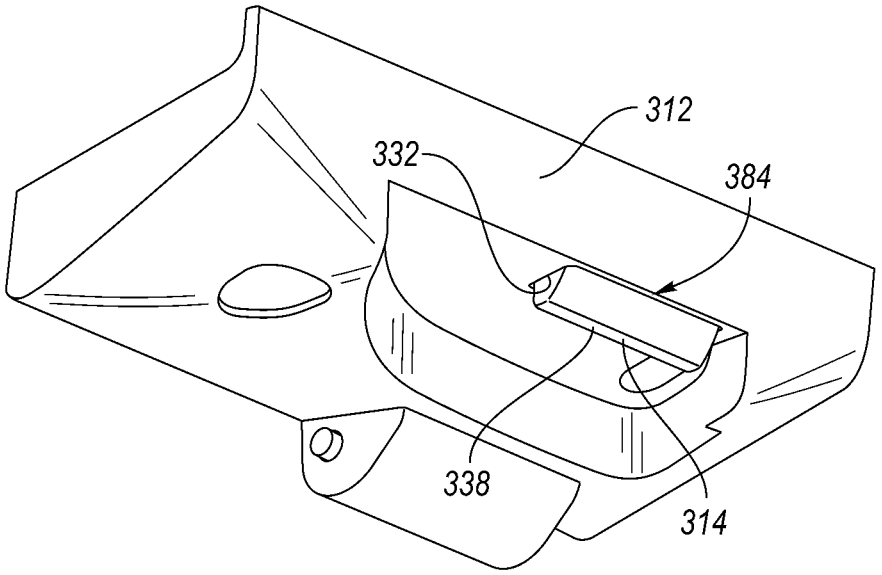
FIG. 6B shows a perspective view of the guide element with the latch shown in the open position.
Figure 7:
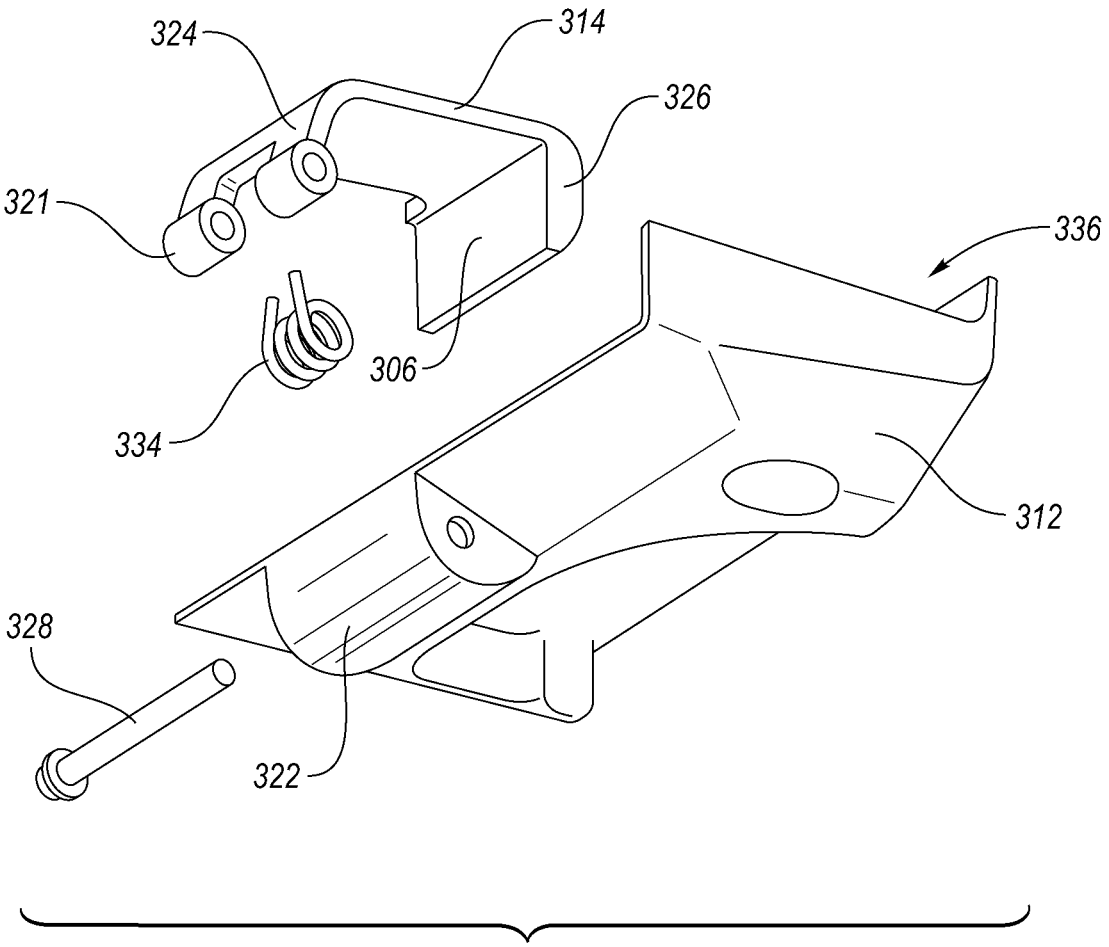
FIG. 7 shows an exploded perspective view of the guide element.

Referring to FIGS. 6A, 6B, and 7, the deflectable member 314 may be pivotally attached to the base 312. The deflectable member 314 may include a first end 321 that is pivotally attached to a portion 322 of the base 312, an intermediate portion 324 that extends from the first end 321, and a hooked end 326 attached to the intermediate portion. The hooked end 326 is the portion that latches with the guide pin 190 and includes the front face 320 and the blocking surface 306. A pin 328 may be used to pivotally attach the deflectable member 314 to the base 312. For example, the first end 321 defines one or more holes and the portion 322 of the base defines one or more holes that receive the pin 328 therein. The hooked end 326 extends through a slot 332 defined by the base 312 allowing the deflectable member 314 to deflect up (deflect position 384, also known as retracted position) and down (blocking position 386). The deflectable member 314 may be biased downwardly so that the hooked end 326 is normally in the blocking position 386. The deflectable member 314 may be biased by a resilient member such as a spring 334. The spring 334 may be a coil spring that is received around the pin 328 and includes a first portion fixed to the base 312 and a second portion fixed to the deflectable member 314. This is just one example, and the deflectable member may be biased by other means. The deflectable member 314 may primarily reside within a back cavity 336 of the base 312 except for the hooked end 326 that extends through the slot 332. The hooked end 326 may include a rounded, angled, or chamfered tip 338 that facilitates upward deflection of the deflectable member 314 to contact with the guide pin 190. When deflected, the hooked end 326 may be partially or fully received within the slot.

The above-described guide element allows the refrigerator door 28 to be fully closed regardless of the position of the mullion bar. This may increase usability and reduce potential of the door failing to close.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator appliance comprising:

a cabinet;

a door pivotally attached to the cabinet;

a mullion bar pivotally attached to the door and including a guide pin, wherein the mullion bar is movable between a deployed position and a tucked position; and a guide element comprising:

a base (i) supported by the cabinet such that an internal space is defined between the base and the cabinet, (ii) having an open forward region, (iii) having a forward-facing guide surface positioned rearward from the open forward region, and (iv) defining a recessed area extending from the open forward region to the forward-facing guide surface, and a deflectable member having (i) a first end disposed in the recessed area and cooperating with the forward-facing guide surface to define an opening sized to receive the guide pin only when the mullion bar is in the tucked position and (ii) a second end disposed with the internal space and pivotably connected to the base rearward relative to the open forward region and the forward-facing guide surface, wherein the first end is deflectable upward and into the internal space upon contact with the guide pin to allow the guide pin within the recessed area when the mullion bar is in the deployed position.

2. The refrigerator appliance of claim 1, wherein the deflectable member is pivotal between a blocking position and a deflected position, wherein the deflectable member is configured to move from the blocking position to the deflected position responsive to contact with the guide pin.

3. The refrigerator appliance of claim 2, wherein the deflectable member is biased to the blocking position via a spring, the spring having coils that are coaxial with an axis at which the second end of the deflectable member pivots.

4. The refrigerator appliance of claim 1, wherein the deflectable member includes a front face having an angled or rounded surface.

5. The refrigerator appliance of claim 1, wherein the recessed area and the first end of the deflectable member cooperate to define a guide path arranged such that the mullion bar pivots between the deployed and tucked positions as the guide pin moves along the guide path.

6. The refrigerator appliance of claim 1, wherein the second end is pivotably connected to the base via a horizontally extending pin.

7. The refrigerator appliance of claim 1, wherein (i) the base includes a protruding region extending downward therefrom, (ii) the protruding region is rearward relative to the forward-facing guide surface, (iii) the protruding region partially defines a lower portion of the internal space, and (iv) the second end is pivotably connect to the base within the lower portion of the internal space.

8. The refrigerator appliance of claim 7, wherein an entirety of the forward-facing guide surface is disposed between the protruding region and the open forward region.

9. A refrigerator appliance comprising:

a cabinet;

first and second doors arranged side-by-side and each pivotally attached to the cabinet;

a mullion bar pivotally attached to the first door and including a stationary guide pin, the mullion bar having a deployed position in which the mullion bar is positioned to support the second door and a tucked position, and a guide element supported by the cabinet and including;

a base (i) positioned below the cabinet such that an internal space is defined between the base and the cabinet, (ii) having an open forward region, (iii) having a forward-facing guide surface positioned rearward from the open forward region, and (iv) defining a recessed area extending from the open forward region to the forward-facing guide surface, and a latch having (i) a first end disposed in the recessed area and cooperating with the forward-facing guide surface to define an opening sized to receive the guide pin only when the mullion bar is in the tucked position and (ii) a second end disposed with the internal space and pivotably connected to the base rearward relative to the open forward region and the forward-facing guide surface, wherein the first end is configured to retract upward and into the internal space upon contact with the guide pin during closing of the first door to allow the guide pin within the recessed area when the mullion bar is in the deployed position, and wherein an entirety of the forward-facing guide surface is disposed between the second end and the open forward region.

10. The refrigerator appliance of claim 9, wherein the base defines a slot, and the latch extends through the slot.

11. The refrigerator appliance of claim 10, wherein the latch includes a first position in which the latch extends through the slot and a second position in which the latch is retracted into the slot.

12. The refrigerator appliance of claim 9, wherein the latch includes a hooked end defining a front surface and a blocking surface, wherein the blocking surface cooperates with the recessed area to define a guide path arranged such that the mullion bar pivots between the deployed and tucked positions as the guide pin moves along the guide path.

13. The refrigerator appliance of claim 12, wherein the blocking surface is planar, and the front surface has a rounded or angled portion.

14. The refrigerator appliance of claim 9, wherein the latch is pivotally attached to the base by a pin and movable between a blocking position and a retracted position, and further comprising a spring having coils that are coaxial with the pin and biasing the latch to the blocking position.

15. A refrigerator appliance comprising a cabinet;

first and second doors arranged side-by-side and each pivotally attached to the cabinet;

a mullion bar pivotally attached to the first door and including a guide pin, the mullion bar having a deployed position in which the mullion bar is positioned to support the second door and a tucked position, and a guide element defining a guide path having an opening sized to receive the guide pin when the mullion bar is in the tucked position, the guide path being arranged such that the mullion bar pivots between the deployed and tucked positions as the guide pin moves along the guide path, wherein the guide element comprises:

a base (i) supported by the cabinet such that an internal space is defined between the base and the cabinet, (li) having a forward region defining the opening, (iii) having a guide surface positioned rearward from the forward region, and (iv) defining a recessed area extending from the forward region to the guide surface and at least partially defining the guide path, and a deflectable member having (i) a first end disposed in the recessed area and cooperating with the guide surface to define the opening and (ii) a second end disposed with the internal space and pivotably connected to the base rearward relative to the forward region and the guide surface, wherein the first end forms a segment of the guide path and is deflectable upward and into the internal space upon contact with the guide pin during closing of the first door to allow the guide pin within the guide path when the mullion bar is in the deployed position allowing the first door to close.

16. The refrigerator appliance of claim 15, wherein the deflectable member is pivotal between a blocking position in which the deflectable member projects out of the base and a deflected position in which the deflectable member is retracted within the base, wherein the deflectable member is configured to move from the blocking position to the deflected position responsive to contact with the guide pin.

17. The refrigerator appliance of claim 16, wherein the guide element further includes a spring configured to bias the deflectable member to the blocking position, the spring having coils that are coaxial with an axis at which the second end of the deflectable member pivots.

18. The refrigerator appliance of claim 15, wherein the second end is pivotably connected to the base via a horizontally extending pin.

19. The refrigerator appliance of claim 15, wherein (i) the base includes a protruding region extending downward therefrom, (ii) the protruding region is rearward relative to the guide surface, (iii) the protruding region partially defines a lower portion of the internal space, and (iv) the second end is pivotably connect to the base within the lower portion of the internal space.

20. The refrigerator appliance of claim 19, wherein an entirety of the guide surface is disposed between the protruding region and the forward region.

* * * * *